United States Patent [19]

Damiano

[11] 4,330,953

[45] May 25, 1982

[54] PNEUMATIC CHRISTMAS TREE DISPLAY

[76] Inventor: Frank Damiano, 322 Washington St., Newburgh, N.Y. 12550

[21] Appl. No.: 151,205

[22] Filed: May 19, 1980

[51] Int. Cl.[3] ..... G09F 19/02; G09F 19/08; A47G 33/04

[52] U.S. Cl. ..... 40/407; 40/412; 40/427

[58] Field of Search ..... 40/409, 410, 412, 406, 40/408, 427, 428, 439, 440, 441, 407; 272/27 R, 15 BN, 15 BF; 239/504, 518, 520; 46/44

[56] References Cited

U.S. PATENT DOCUMENTS

| | | | |
|---|---|---|---|
| 549,359 | 11/1895 | Hawks | 239/520 |
| 2,092,520 | 9/1937 | Nielsen | 40/412 |
| 3,081,949 | 3/1963 | Simmons | 239/520 |
| 3,415,513 | 12/1968 | Burnbaum | 272/27 R |
| 3,905,140 | 9/1975 | Damiano | 40/409 |
| 4,028,830 | 6/1977 | Ottinger | 40/410 |

FOREIGN PATENT DOCUMENTS

| | | | |
|---|---|---|---|
| 526761 | 9/1940 | United Kingdom | 272/15 |

*Primary Examiner*—Gene Mancene

*Assistant Examiner*—Michael J. Foycik

*Attorney, Agent, or Firm*—William T. Hough

[57] ABSTRACT

A Christmas tree display includes a hollow trunk as upright support structure on which in a direction from bottom to top there is mounted an upwardly and outwardly-flared air-diverter element positioned such that upwardly-directed air from a lower fan casing is directed outwardly against pneumatically actuatable motor-elements of ornamental designs, and a portion of air from the motor-driven fan of the fan casing is directed into and upwardly through the hollow trunk to another pneumatically actuatable motor-element of ornamental design, and helical limb-support elements extend laterally from the upright support structure and support leaf-bearing limbs inserted through and supported by the helical portions of the helical limb-support elements, one or more of the limb-support elements or limbs having the pneumatically actuatable motor-elements suspended therefrom and one or more of the motor-elements including an electric light bulb shaded to direct light downwardly and/or upwardly to prevent glare to the observing eye.

7 Claims, 2 Drawing Figures

PNEUMATIC CHRISTMAS TREE DISPLAY

This invention is directed to an artificial Christmas tree.

BACKGROUND TO THE INVENTION

Prior to the present invention, there have existed mechanical Christmas trees such as those illustrated in U.S. Pat. Nos. 4,028,830 and 4,076,234 and 3,147,175 each of which have base-mounted catch basins of hemispherical or conically-concave shape mounted below the tree such that upwardly-blown snow falls therein for recycling; in these patents, propelled air is channeled solely upwardly through the central trunk, and the snow-like material is permitted to fall by gravitational pull downwardly to the catch basin.

U.S. Pat. No. 3,905,140 belonging to the present inventor, likewise discloses a mechanical Christmas tree blowing the snow-like material solely upwardly through the central hollow trunk, and exterior thereto solely the snow falling freely by gravitational pull; in that patent, pneumatically actuable ornaments (motors) were actuated by pressurized air supplied through also hollow branches. Also in that patent, an inverted downwardly facing cone small at the top and large laterally downwardly with the concave portion facing downwardly served as a flare deflector to thwart the upward flow or draft of air from the pump or fan.

The U.S. Pat. No. 3,035,162 discloses typical pneumatically actuatable motors designed as ornaments for a Christmas tree, actuatable by being struck by exteriorly-circulated air.

SUMMARY OF THE INVENTION

Thus, prior to the present invention, there is no apparent prior art which discloses or suggests the function nor other objects of the present invention, as follows.

An object of the present invention is to obtain a mechanical pneumatic display device utilizing pressurized air or circulated air-actuatable motor-elements actuatable by air pressure exterior thereto, directed uniformly and effectively thereagainst.

Another object is to obtain a mechanical pneumatic display device having appropriate mechanism for effectively directing pressurized air both exteriorly to and interiorly of hollow support structure effectively to actuate exteriorly-actuatable motorized elements and to actuate other interiorly-actuatable motorized elements.

Another object is to obtain maximum and optimal air pressure for interior channeling while concurrently obtaining high intensity of exterior movement of pressurized air in desired directions.

Another object is to obtain a mechanical Christmas tree having improved structures for supporting artificial or actual tree limbs and for supporting pneumatically actuatable motor ornaments and other ornaments.

Another object is to obtain improved tree-lighting from the Christmas tree light-ornaments to prevent glare to the observer.

Other objects become apparent from the preceding and following disclosure.

One or more objects of the invention are obtained by the invention as typically illustrated in the accompanying drawings intended to improve understanding of the nature of the invention but not to unduly limit the invention that extends to other variations and modifications within the ordinary skill of the art.

Broadly the invention may be described as a pneumatic display device having a fan-enclosing fan casing with lower inlet ports and at least a first outlet port that channels air from the motor-driven fan toward and against pneumatically actuatable motor-elements supported by upright support structure mounted on the casing with the upright support structure having mounted thereon an upwardly and outwardly-flared air-diverter element. The air-diverter element serves to direct upwardly and radially outwardly or laterally-outwardly pressurized air directed thereagainst from the outlet port of the fan casing.

Preferably there is also at least a second outlet port of the casing positioned and connected to direct and channel a portion of pressurized air from the fan into an air channel formed by the hollow nature of the upright support structure, channeling pressurized air to a pneumatically actuatable motor-element support-position. Thus, air is received into the air channel by a channel inlet, and channeled to a channel outlet.

In a further preferred embodiment, the second outlet port is positioned about centrally of an upper portion of the fan casing, and the channel inlet is positioned thereabove in spaced-away relationship in order that a portion of air from the second outlet port passes interiorly of and into the channel inlet while a remaining significantly large portion of the air from the second outlet port passes exteriorly of and upwardly around the upright support structure and against the air-diverter element.

In an alternate preferred embodiment, the second outlet port is positioned substantially perpheral to and circumscribing the lateral edges of the space within which the fan is mounted in the fan casing, in which the fan is a centrifugal-action fan that drives air substantially radially outwardly. The channel inlet is typically mounted integrally with or on the fan casing in flow communication with the second outlet port for receiving a significantly large portion of highly pressurized air driven by the centrifugal-action fan. The air, thereupon as in the prior description, is channeled through the air channel to the channel outlet.

As a functional part of the invention, the pneumatically actuatable motor-elements must be positioned to receive diverted air diverted by the uprightly-supported upwardly and outwardly-flared air-diverter element such that they are actuated by exterior pressure of the pressurized air thereon. Accordingly, a further preferred embodiment of the invention includes limb-support elements extended from mounting positions on the upright structure and extending laterally outwardly from the upright support structure to provide support for the pneumatically actuatable motor-elements or support for artificial or real tree limbs that in turn provide support for the pneumatically actuatable motor-elements to be actuated by the exterior pressurized air.

In a further preferred embodiment, the pneumatically actuable motor-elements embody electric light bulb(s) and shading or shielding that prevents lateral light-glare and directs the light solely substantially upwardly and/or downwardly.

An ultimate preferred embodiment, to which the objects of the present invention are principally directed, the upright support structure is formed to simulate a tree trunk of a Christmas tree, and the limb-support elements and limbs supported thereby are such that the entire combination constitutes a mechanical Christmas tree.

The invention may be better understood by making reference to the following Figures which illustrate preferred embodiments of the invention.

THE FIGURES

DETAILED DESCRIPTION

Figure 1:
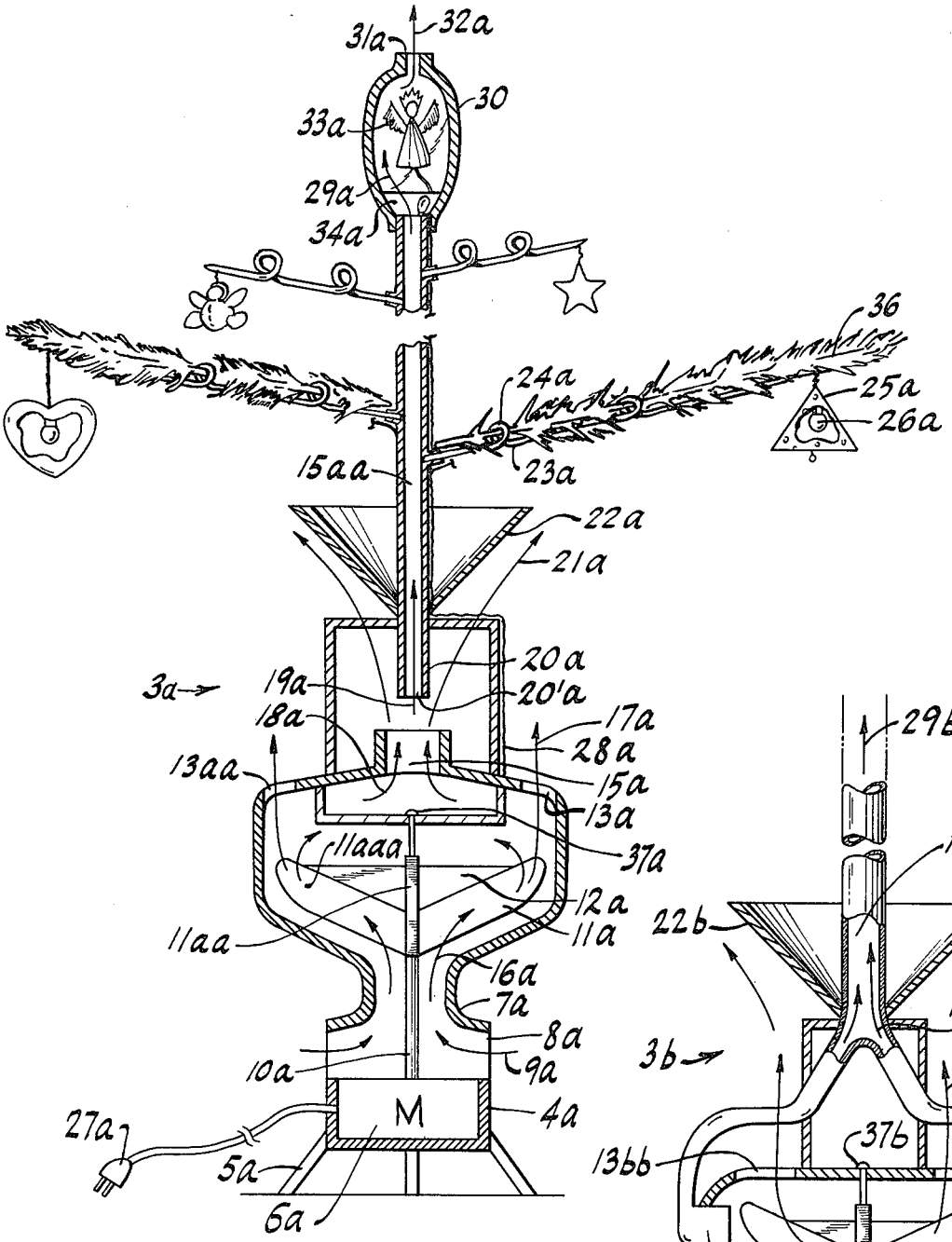
FIG. 1 illustrates a mechanical Christmas tree display, diagrammatically and not to scale, in side cross-sectional view of most parts thereof, together with its integral fan and fan-motor-encasing fan casing and support feet thereof.
Figure 2:
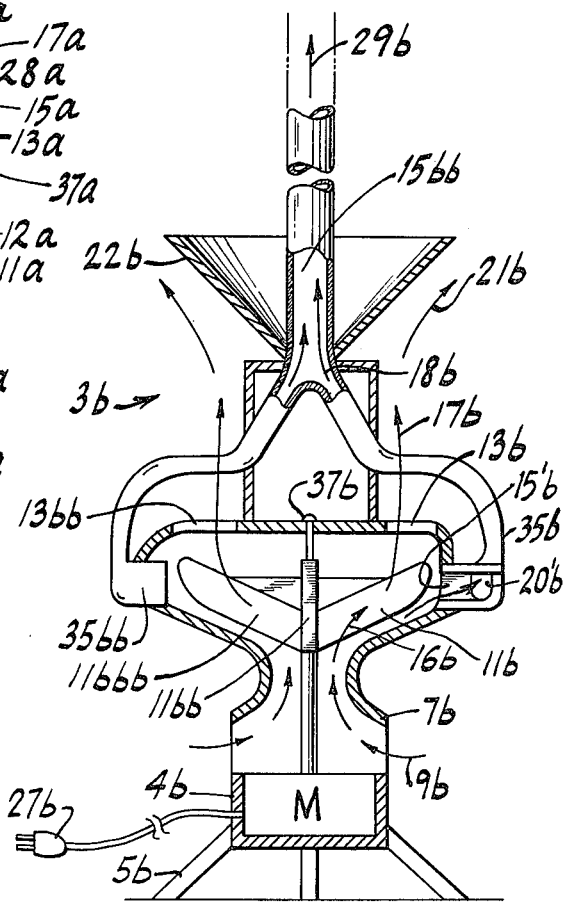
FIG. 2 illustrates in-part an alternate embodiment of the invention of FIG. 1, the portion not illustrated being identical to other illustrated portions of FIG. 1; likewise, this Figure illustrates a mechanical Christmas tree display, diagrammatically and not to scale, in side cross-sectional view.

In greater detail, FIGS. 1 and 2 disclose embodiments which differ only in certain particulars, but are otherwise similar in some regards, and identical in still other regards. The portions of FIG. 2 that are not illustrated are, for purposes of this disclosure, to be considered identical to that of FIG. 1. As regards substantially similar and also for identical portions that are illustrated, common numerals are utilized, for example the Christmas tree display 3*a* of FIG. 1 and 3*b* of FIG. 2.

Accordingly, in reference to FIG. 1, the Christmas tree display 3*a* includes a motor and fan casing 4*a* enclosing the motor 6*a* and centrifugal-action fan shaft 10*a*, radially-extending impellers 11*a*, 11*aa*, and 11*aaa*, and shaft-support structure mounting fan-shaft end 37*a*, with the casing 4*a* mounted on the legs 5*a*. Upright support structure is mounted on top of and above the fan casing 4*a*. The upright support structure and extensions thereon include the tree trunk channel-forming upright structure 20*a* the mounted outwardly-flared air-diverter element 22*a*, limb-support elements 23*a* with helical portions 24*a*, and pneumatically-actuateable motor-elements 25*a* having electric light bulbs 26*a*; the light bulb 26*a* is mounted within a bell that by its natural shape shades and deflects the light downwardly, avoiding glare to the eyes of the observer.

The motor 6*a* is powered typically through electricl plug 27*a*. The fan casing has air inlet port 8*a* and air outlet ports 13*a*, 13*aa*, and 15*a*. The upright tubular structure 20*a* has channel inlet 20'*a* and channel outlet 31*a*. The upper end of the channel structure has transparent wall 30 as housing for pneumatically actuatable motor-element—an angel 33*a* and electric light bulb with shield (upwardly-directed reflector) 34*a*. The channel-forming upright tubular structure 20*a* has its channel 15*aa*.

In operation, intake air is sucked-in into the inlet ports 8*a* in directions 9*a*, traveling upwardly in direction 16*a*, and then in directions 17*a* and 18*a*. A portion of pressurized air travels in direction 19*a* and other is diverted in direction 21*a*. The air traveling in direction 19*a* passes toward the angel in direction 29*a* and outwardly in direction 32*a*.

In FIG. 2, the outlet ports 15'*b* are peripherally located at outer circumscribing edges of the fan casing at the ends of the radially-outwardly extending impellers 11*b*, 11*bb* and 11*bbb*, for example; it is noted that the compressed air is also rotating within the casing while being flung radially outwardly and is thus captured at high pressure within the outlet ports 15*b*, and eventually channeled in chanel direction 18*b* and 15*bb* upwardly. Pressurized air exiting from outlet ports 13*b* travels upwardly in directions 17*b* and is diverted into directions 21*b*. All other aspects correspond to the description of FIG. 1.

It is within the scope of the invention to make variations and substitution of equivalents and modifications as would be apparent to a person having ordinary skill in this art.

I claim:

1. A pneumatic display device comprising in combination: a fan casing having lower inlet ports and having first outlet ports, each of the inlet ports and outlet ports being in direct communication with exterior non-enclosed space, and channeling air from the lower inlet ports through an enclosed through-space within the casing's interior and thereafter through said first outlet ports; and a motor mounted within and on the fan casing; and a fan mounted within the enclosed through-space within the fan casing and driven by said motor; and upright support structure mounted on the fan casing, supporting an upwardly and outwardly-flared air-diverter element positioned to divert air passing from said first outlet ports; and the upright support structure further supporting pneumatically actuatable motor-elements positioned at locations to receive diverted air diverted by the outwardly-flared air diverter element.

2. A pneumatic display device of claim 1, in which said fan casing has additionally a second outlet port positioned and shaped to channel fan-driven air from space within the fan casing through the second outlet port, said upright support structure including an air channel therein extending between a channel inlet and a channel outlet thereof, and said channel inlet being positioned to receive fan driven air from said second outlet port such that driven air passes through the air channel and out of said channel outlet.

3. A pneumatic display device of claim 2, in which said second outlet port is positioned substantially centrally in an upper portion of said fan casing and in which said channel inlet is positioned above and spaced from said second outlet port such that a first portion of fan-driven air passes into said channel inlet and a second portion of fan-driven air passes exterior to the channel inlet as fan-driven air passes out of the second outlet port.

4. A pneumatic display device of claim 2, in which said second oulet port is positioned substantially peripheral to and in communication with the enclosed through-space within which the fan is mounted, said fan being a centrifugal-action fan of a type that drives substantially radially outwardly, and said channel inlet being mounted integrally and in a substantially sealed relationship in communication with said second outlet port such that a portion of centrifugally-driven air is channeled through said air channel.

5. A pneumatic display device of claim 1, including limb-support elements extending laterally outwardly from said upright support structure, each limb-support element including a plurality of helical configurations, and limb members each extending through said plurality and supported thereby.

6. A pneumatic display device of claim 1, in which at least one of said pneumatically actuatable motor-elements is a downwardly hanging bell in shape and has mounted therein an electrically-powered electric light bulb such that light is directed downwardly.

7. A pneumatic display device comprising in combination: a fan casing having a lower inlet port and having a first outlet port and channeling air from the lower inlet port through space within the casing interior and thereafter through said first outlet port; and a motor mounted within and on the casing; and a fan mounted within the casing and driven by said motor; and the upright support structure further supporting pneumatically actuatable motor-elements positioned at locations to receive fan-driven air from said first outlet port; said fan casing having additionally a second outlet port positioned and shaped to channel fan-driven air from enclosed through space within the fan casing through the second outlet port, said upright support structure including an air channel therein extending between a channel inlet and a channel outlet thereof, and said channel inlet being positioned to receive fan driven air from said second outlet port such that driven air passes through the air channel and out of said channel outlet; and said second outlet port being positioned substantially peripheral to the enclosed through space within which the fan is mounted, said fan being a centrifugal-action fan of a type that drives air substantially radially outwardly, and said channel inlet being mounted integrally and in a substantially sealed relationship in communication with said second outlet port such that a portion of centrifugally-driven air is channeled through said air channel.

* * * * *